US007717257B1

(12) United States Patent
Lu et al.

(10) Patent No.: US 7,717,257 B1
(45) Date of Patent: May 18, 2010

(54) MULTI-SECTION PACKAGE FOR A MOLD RELEASE AGENT AND A WIPE

(75) Inventors: Zheng Lu, Glastonbury, CT (US); Dennis L. Cardoza, Brentwood, CA (US); Richard Varien, Danville, CA (US)

(73) Assignee: Henkel Corporation, Rocky Hill, CT (US)

( * ) Notice: Subject to any disclaimer, the term of this patent is extended or adjusted under 35 U.S.C. 154(b) by 294 days.

(21) Appl. No.: 11/742,602

(22) Filed: May 1, 2007

Related U.S. Application Data

(60) Provisional application No. 60/796,736, filed on May 2, 2006.

(51) Int. Cl.
*B65D 65/00* (2006.01)

(52) U.S. Cl. ..... 206/221; 206/451

(58) Field of Classification Search ..... 206/219, 206/221, 205, 207, 233, 494, 449, 451, 524.1
See application file for complete search history.

(56) References Cited

U.S. PATENT DOCUMENTS

| | | | | | |
|---|---|---|---|---|---|
| 3,149,943 | A * | 9/1964 | Amador | 62/4 |
| 3,556,290 | A * | 1/1971 | Popkin-Clurman | 206/221 |
| 3,608,708 | A | 9/1971 | Storandt | 206/46 |
| 3,980,225 | A | 9/1976 | Kan | 229/57 |
| 4,011,945 | A * | 3/1977 | Bourne et al. | 206/223 |
| 4,085,244 | A | 4/1978 | Stillman | 428/192 |
| 4,252,238 | A | 2/1981 | Spiegelberg et al. | 206/210 |
| 4,570,820 | A | 2/1986 | Murphy | 221/34 |
| 4,727,705 | A | 3/1988 | Zahka | 53/425 |
| 5,320,217 | A | 6/1994 | Lenarz | 206/209 |
| 5,370,221 | A * | 12/1994 | Magnusson et al. | 206/221 |
| 5,372,429 | A | 12/1994 | Beaver, Jr. et al. | 383/109 |
| 5,417,035 | A | 5/1995 | English | 53/412 |
| 5,487,932 | A | 1/1996 | Dunshee | 428/68 |
| 5,595,786 | A | 1/1997 | McBride, Jr. et al. | 427/299 |
| 5,616,337 | A * | 4/1997 | Kasianovitz et al. | 424/414 |
| 5,639,532 | A | 6/1997 | Wells | 428/95 |
| 5,688,394 | A | 11/1997 | McBride, Jr. et al. | 206/233 |
| 5,941,378 | A | 8/1999 | Rose et al. | 206/205 |
| 6,286,670 | B1 * | 9/2001 | Smith | 206/221 |
| 6,505,740 | B1 | 1/2003 | Marlin et al. | 206/524.5 |
| 6,648,133 | B1 * | 11/2003 | Blaschke et al. | 206/221 |
| 7,357,248 | B2 * | 4/2008 | Sivakumar et al. | 206/219 |
| 2001/0030134 | A1 * | 10/2001 | Goglio et al. | 206/221 |
| 2005/0087458 | A1 * | 4/2005 | Richards et al. | 206/219 |
| 2006/0283728 | A1 * | 12/2006 | Patrick et al. | 206/229 |
| 2007/0080078 | A1 * | 4/2007 | Hansen et al. | 206/219 |

* cited by examiner

*Primary Examiner*—Jacob K Ackun, Jr.
(74) *Attorney, Agent, or Firm*—Steven C. Bauman

(57) ABSTRACT

A sealed multi-compartment package includes a wipe and a mold release agent which are kept separate from one another until the time of use. The package includes a first compartment for containing a fabric-like wipe and a second compartment in sealed separation from the first compartment containing a mold release agent. The first and second compartments are in communication and separated by a displaceable seal. Upon displacement of the seal, the mold release agent and the wipe are brought into mutual contact.

4 Claims, 2 Drawing Sheets

MULTI-SECTION PACKAGE FOR A MOLD RELEASE AGENT AND A WIPE

FIELD OF THE INVENTION

The present invention relates generally to a packaging technique for packaging a substance such a mold release agent in combination with a wipe for applying the mold release agent. More particularly, the present invention relates to a package which separates the mold release agent from the wipe until such time as application is desired.

BACKGROUND OF THE INVENTION

Mold release agents are commonly used to coat the internal surfaces of a mold cavity so as to permit a product molded therein to be easily released upon opening of the mold. The art has various techniques for applying the mold release agent to the mold cavity. Commonly, the mold release agent is in liquid form and is applied to the mold directly by, for example, a spray, such as an aerosol spray. The liquid may also be applied to a fabric-like wipe for application onto the mold.

The fabric-like wipe may contain moisture and/or functional groups that will chemically react with the release agent. Thus, pre-moistening or saturating the wipes at a time well prior to application may be disadvantageous.

In addition, where the liquid release agent is used directly on the mold or applied to a wipe just prior to application, the amount of release agent applied cannot be accurately metered.

Additionally, certain of the mold release agents include a solvent. Bulk application of the mold release agent to the mold or to a wipe may result in unnecessary exposure to the solvents contained in the release agent.

It is, therefore, desirable to provide a technique for packaging wipes used to apply mold release agents in a manner which safely and efficiently applies the release agent to the wipe just prior to mold application and which minimizes handling of the contents.

Moreover, when handling, transporting or storing the release agent, there is the risk of spillage.

SUMMARY OF THE INVENTION

The present invention provides in one embodiment a sealed multi-compartment package assembly comprising:

a first compartment for containing a fabric-like wipe; and a second compartment in sealed separation from said first compartment for containing a mold release agent;

said first and second compartments being in communication and being separated by a displaceable seal. Upon displacement of the seal, the mold release agent and the wipe are brought into mutual contact.

DETAILED DESCRIPTION OF THE INVENTION

Figure 1:
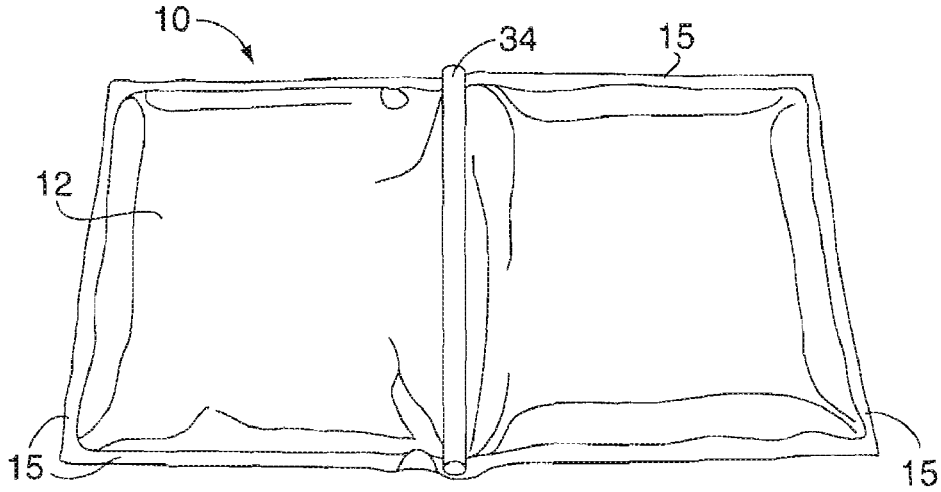
FIG. 1 is a photograph of a top view of the multi-section package containing a mold release agent and wipe of the present invention.
Figure 2:
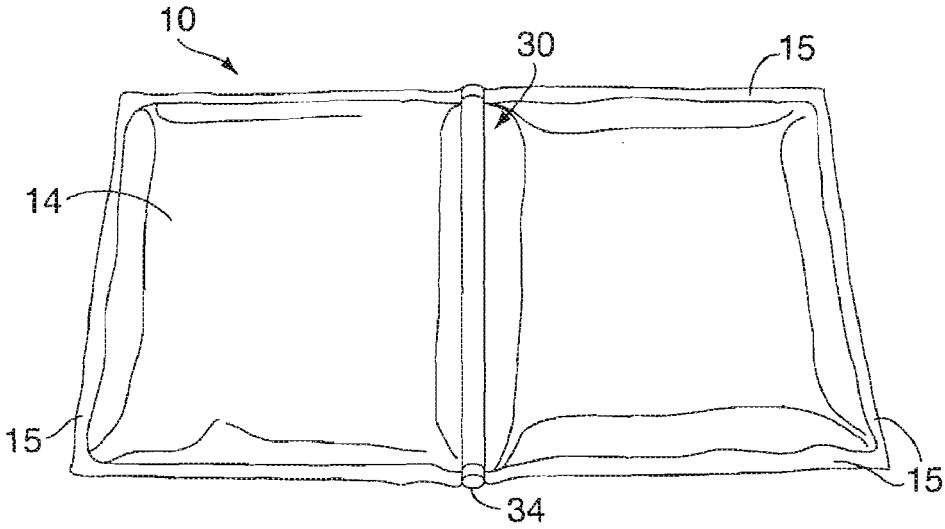
FIG. 2 is a photograph of the bottom of the multi-section package of FIG. 1.
Figure 3:
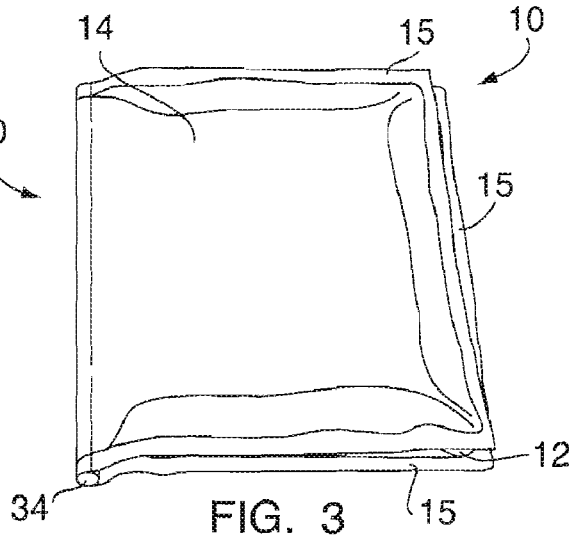
FIG. 3 shows the multi-section package of FIG. 1 in folded condition.

As noted above, the present invention provides a package for separately containing a mold release agent and a fabric-like wipe to apply the mold release agent. One common mold release agent which may be used in accordance with the present invention is a liquid mold release agent of the type sold by Henkel Corporation under the registered trademark FREKOTE®.

More specifically, the present invention may employ a mold release agent of the type shown and described in pending U.S. patent application Ser. No. 10/565,499, filed Jul. 20, 2004, entitled "Low VOC/Solvent Based Mold Release Agent and Curable Mold Release Compositions Based Thereon". This application is incorporated herein by reference for all purposes.

In addition to the formulations of the mold release and agent disclosed in the above-referenced application, the following formulations illustrated in Examples 1-11 may also be employed as a mold release agent in the present invention.

EXAMPLES

Example 1

The weight percent of each of the following components in the composition is set forth: tri methylamino functional silane; hydroxy functional siloxanes; $C_6$-$C_{11}$ aliphatic solvent; and $C_7$-$C_{14}$ aromatic solvent. This combination formed a high gloss, room temperature moisture curing application.

| Component | wt. % |
|---|---|
| Tri methylamino functional silane | 0.01-2 |
| Hydroxy functional siloxanes | 0.01-3 |
| $C_6C_{11}$ aliphatic solvent | 0-99.9 |
| $C_7$-$C_{14}$ aromatic solvent | 0-99.9 |

Example 2

The weight percent of each of the following components in the composition is set forth: tri methylamino functional silane; cyclic tri silazane hydroxy functional siloxanes; $C_6$-$C_{11}$ aliphatic solvent; and $C_7$-$C_{14}$ aromatic solvent. This combination formed a high gloss, room temperature moisture curing application.

| Component | wt. % |
|---|---|
| Tri methylamino functional silane | 0.01-2 |
| Cyclic tri silazane | 0.01-1 |
| Hydroxy functional siloxanes | 0.01-3 |
| $C_6C_{11}$ aliphatic solvent | 0-99.9 |
| $C_7$-$C_{14}$ aromatic solvent | 0.99.9 |

Example 3

The weight percent of each of the following components in the composition is set forth: tri methylamino functional silane; cyclic tri silazane; hydroxy functional siloxanes;

$C_6$-$C_{11}$ aliphatic solvent; and cyclic/linear methylated siloxane. This combination formed a high gloss, room temperature moisture curing application.

| Component | wt. % |
|---|---|
| Tri methylamino functional silane | 0.01-2 |
| Cyclic tri silazane | 0-1 |
| Hydroxy functional siloxanes | 0.01-3 |
| $C_6C_{11}$ aliphatic solvent | 0-99.9 |
| Cyclic/linear methylated siloxane | 10-90 |

Example 4

The weight percent of each of the following components in the composition is set forth: tri enoxy functional silane; hydroxyl functional siloxanes; $C_6$-$C_{11}$ aliphatic solvent; and cyclic/linear methylated siloxane. This combination formed a high gloss, room temperature moisture curing application.

| Component | wt. % |
|---|---|
| Tri enoxy functional silane | 0.01-3 |
| Hydroxyl functional siloxanes | 0.01-3 |
| $C_6C_{11}$ aliphatic solvents | 0-99.9 |
| Cyclic/linear methylated siloxane | 10-90 |

Example 5

The weight percent of each of the following components in the composition is set forth: polysilazanes; tri methyl amino silane; hydroxy functional siloxanes; and $C_6$-$C_{11}$ aliphatic solvent. This combination formed a high gloss, room temperature moisture curing application.

| Component | wt. % |
|---|---|
| Polysilazanes | 0.01-5 |
| Tri methyl amino silane | 0.01-1 |
| Hydroxy functional siloxanes | 0.01-5 |
| $C_6C_{11}$ aliphatic solvent | 0-99.9 |

Example 6

The weight percent of each of the following components in the composition is set forth: tri enoxy functional silane; hydride functional silane; hydroxyl functional siloxanes; tin catalyst; and cyclic/linear methylated siloxane. This combination formed a high gloss, room temperature moisture curing application.

| Component | wt. % |
|---|---|
| Tri enoxy functional silane | 0.01-3 |
| Hydride functional silane | 0.01-1 |
| Hydroxy functional siloxanes | 0.01-3 |
| Tin catalyst | 0.001-0.5 |
| Cyclic/linear methylated siloxane | 50-99.9 |

Example 7

The weight percent of each of the following components in the composition is set forth: tri methylamino functional silane; cyclic tri silazane; hydroxy functional siloxanes; $C_6$-$C_{11}$ aliphatic solvent; and cyclic/linear methylated siloxane. This combination formed a high gloss, room temperature moisture curing application.

| Component | wt. % |
|---|---|
| Tri methylamino functional silane | 0.01-2 |
| Cyclic tri silazane | 0-1 |
| Hydroxy functional siloxanes | 0.01-3 |
| $C_6$-$C_{11}$ aliphatic solvent | 0-99.9 |
| Cyclic/linear methylated siloxane | 10-90 |

Example 8

The weight percent of each of the following components in the composition is set forth: tetra vinyl cyclosiloxane; mercapto functional siloxane; vinyl functional siloxane; camphorquinone; $C_6$-$C_{11}$ aliphatic solvent; and DM-p-T. This combination formed a high gloss, room temperature moisture curing application.

| Component | wt. % |
|---|---|
| Tetra vinyl cyclosiloxane | 0.01-10 |
| Mercapto functional siloxane | 0.02-10 |
| Vinyl functional siloxane | 0-10 |
| Camphorquinone | 0.01-0.5 |
| $C_6C_{11}$ aliphatic solvent | 0-99.9 |
| DM-p-T | 0-0.01 |

Example 9

The weight percent of each of the following components in the composition is set forth: vinyl functional siloxane; hydride functional siloxanes; platinum catalyst; and $C_6$-$C_{11}$ aliphatic solvent. This combination formed a high gloss, room temperature moisture curing application.

| Component | wt. % |
|---|---|
| Vinyl functional siloxane | 0.01-15 |
| Hydride functional siloxanes | 0.01-10 |
| Platinum catalyst | 0.01-1 |
| $C_6C_{11}$ aliphatic solvent | 0-99.9 |

Example 10

The weight percent of each of the following components in the composition is set forth: tri ethoxy functional silane; hydroxy functional siloxanes; water; surfactants (HLB 2-30); wetting agent; and tin catalyst. This combination formed a high gloss, room temperature moisture curing application.

| Component | wt. % |
|---|---|
| Tri ethoxy functional silane | 0.01-10 |
| Hydroxy functional siloxanes | 0.01-5 |
| Water | 0-99.9 |
| Surfactants (HLB 2-30) | 0.01-5 |
| Wetting agent | 0.01-1 |
| Tin catalyst | 0-1 |

Example 11

The weight percent of each of the following components in the composition is set forth: tri methoxy functional silane; surfactants; hydroxy functional siloxanes; water; and inhibitors. This combination formed a high gloss, room temperature moisture curing application.

| Component | wt. % |
|---|---|
| Tri methoxy functional silane | 0.01-10 |
| Surfactants | 0-3 |
| Hydroxy functional siloxanes | 0.01-3 |
| Water | 0-99.9 |
| Inhibitors | 0.01-1 |

The present invention provides a package which contains the mold release agent in liquid form and the wipe, and which separates the mold release agent from the wipe until such time as application is desired.

Referring now to the figures. Package 10 is a flexible package formed of two generally rectangular sheets 12 and 14 sealed about the peripheral edge 15 by a heat seal or other common seal. It is also contemplated that one end of the package 10 could include a slidable zip closure so as to more easily remove the saturated wipe from the package as will be described in detail herein below. The package defines a package interior 16 which houses both the release agent and the unmoistened fabric-like wipe. The package 10 is divided into two separate side-by-side compartments 20 and 22 which are in central communication such that one compartment houses the unmoistened wipe 20*a* while the other compartment houses the liquid release agent 20*b*.

A central seal 30 is established between the two compartments 20 and 22. Seal 30 is a displaceable seal which provides sealed separation between the two compartments, but when removed, establishes communication therebetween such that the liquid mold release agent may be intermixed with the fabric-like wipe thereby impregnating the fabric-like wipe with the release agent.

Figure 4:
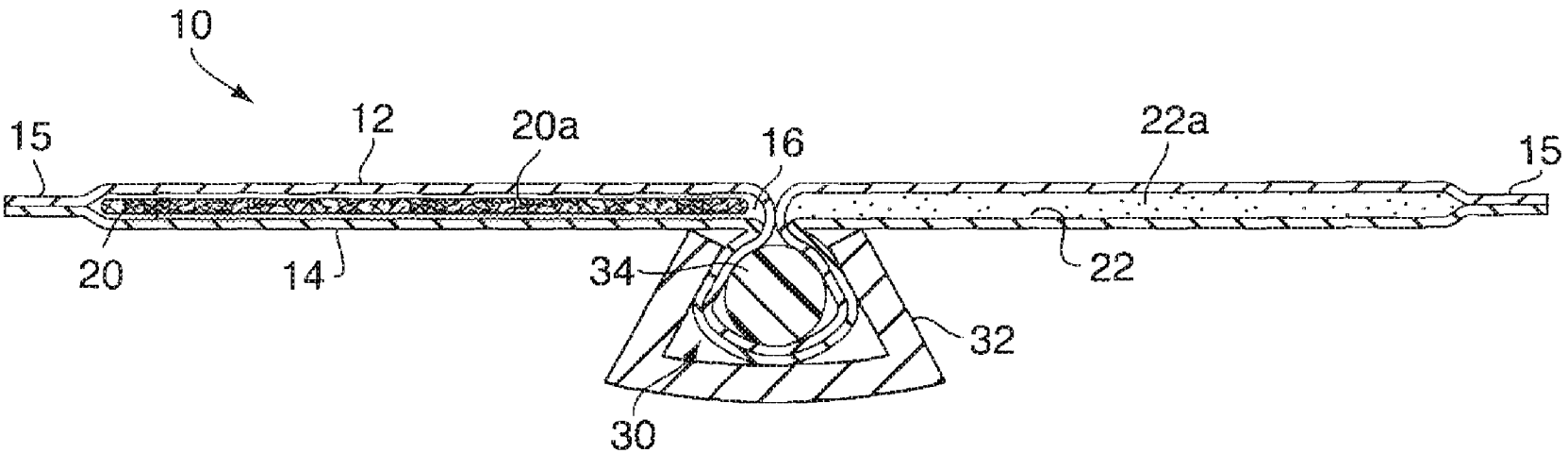
FIG. 4 is a cross-sectional schematic representation of the embodiment of FIG. 1.

While it is within the contemplation of the present invention to provide any type of displaceable seal between the two compartments 20 and 22 (for example, a burstable seal), the present invention, however, shows as a preferred embodiment a seal 30 including a removable clip 32 and rod 34 which is sealably applied between the two compartments. As shown in the figures, particularly FIG. 4, clip 30, which is schematically shown as spring bias clip, is used to crimp seal a central portion of the package 10. In that regard, a longitudinal rod 34 is placed transversely across the package between the compartments 20 and 22 containing the wipe and the release agent. Thereafter, the clip 32 is placed around the rod 34 as shown in FIG. 4 capturing that portion of the package therein. The clip 22 which extends along the length of the rod 34 effectively seals the compartments from each other by crimping package 10 thereat. The seal 30 formed by the clip 32 and the rod 34 is displaceable by removal of the clip and the rod thus establishing communication between the two compartments 20 and 22.

The wipe may be in the form of a towelette, formed of Rayon or similar materials. The wipe is approximately 13"× 13". Approximately 32 gm of mold release agent is used per towel. It is also contemplated that more than one towel/wipe may be provided in each package. For example, a package containing 5 or 10 towels/wipes may be employed.

The present invention thus provides a package which contains a liquid mold release agent and a wipe, which is maintained separately in sealed condition until such time as it is desired to apply the mold release agent. Moreover, the package and the wipe have been selected so that the wipe is saturated with the proper amount of mold release agent. By providing a package which maintains separation between the mold release agent and the wipe until such time as application is desired, the shelf life of the product is substantially increased.

Thus, after the fabric-like wipe has been saturated with the mold release agent, the package 10 can be opened removing the saturated wipe for direct application to the mold. In one example, the peripheral edge 1 at the end may be opening by ripping the heat seal, or if provided, the slideable closure (not shown) may be opened.

What is claimed is:

1. A sealed multi-compartment package assembly comprising:

a first compartment in which is contained a fabric-like wipe; and a second compartment in sealed separation from said first compartment in which is contained a moisture-curing mold release agent;

said first and second compartments being in communication and being separated by a rod positionable across said package between said compartments, and a clip engaging said rod with said package therearound;

wherein upon removal of said rod, said mold release agent and said wipe are brought into mutual contact without rupture of any portion of the package.

2. A multi-compartment package assembly of claim 1 wherein said mold release agent is liquid.

3. A multi-compartment package assembly of claim 2 wherein said mold release agent includes a solvent.

4. A multi-compartment package assembly of claim 1 further including a zip closure for accessing the interior of said package.

* * * * *